US008596029B2

(12) United States Patent
Pedmo et al.

(10) Patent No.: US 8,596,029 B2
(45) Date of Patent: Dec. 3, 2013

(54) SYSTEM AND METHOD FOR PRESSURIZING A PLASTIC CONTAINER

(75) Inventors: Marc Pedmo, Litchfield, OH (US); Richard C. Darr, Medina, OH (US)

(73) Assignee: Plastipak Packaging, Inc., Plymouth, MI (US)

( * ) Notice: Subject to any disclaimer, the term of this patent is extended or adjusted under 35 U.S.C. 154(b) by 474 days.

(21) Appl. No.: 12/702,370

(22) Filed: Feb. 9, 2010

(65) Prior Publication Data

US 2010/0199611 A1 Aug. 12, 2010

Related U.S. Application Data

(60) Provisional application No. 61/151,363, filed on Feb. 10, 2009.

(51) Int. Cl.
*B65B 1/04* (2006.01)

(52) U.S. Cl.
USPC ..... 53/471

(58) Field of Classification Search
USPC ..... 53/467, 471, 478, 485, 113, 127, 266.1
See application file for complete search history.

(56) References Cited

U.S. PATENT DOCUMENTS

| | | | | |
|---|---|---|---|---|
| 4,040,233 | A | 8/1977 | Valyi | |
| 4,318,882 | A | 3/1982 | Agrawal et al. | |
| 4,338,765 | A * | 7/1982 | Ohmori et al. | 53/452 |
| 4,356,681 | A | 11/1982 | Barnes | |
| 4,863,046 | A | 9/1989 | Collette et al. | |
| 5,090,180 | A | 2/1992 | Sorensen | |
| 5,281,387 | A | 1/1994 | Collette et al. | |
| 5,419,866 | A | 5/1995 | Valyi | |
| 5,540,879 | A | 7/1996 | Orimoto et al. | |
| 5,614,148 | A | 3/1997 | Beck et al. | |
| 5,673,808 | A | 10/1997 | Valyi | |
| 5,735,420 | A | 4/1998 | Nakamaki et al. | |
| 5,884,792 | A | 3/1999 | Krishnakumar et al. | |
| 6,062,408 | A | 5/2000 | Beck et al. | |
| 6,502,369 | B1 | 1/2003 | Andison et al. | |
| 6,568,156 | B2 | 5/2003 | Silvers et al. | |

(Continued)

FOREIGN PATENT DOCUMENTS

| | | |
|---|---|---|
| DE | 195 20 925 A1 | 12/1996 |
| FR | 2 772 365 A1 | 6/1999 |

(Continued)

OTHER PUBLICATIONS

European Patent Office, International Search Report and Written Opinion issued in counterpart PCT application No. PCT/US2010/023568. Date of Mailing: Aug. 2, 2010.

*Primary Examiner* — Hemant M Desai
(74) *Attorney, Agent, or Firm* — Dykema Gossett PLLC

(57) ABSTRACT

A system for manufacturing a plastic container, including a thin-walled container, includes an actuator and a base unit. The actuator may include a body portion and a holding/securing member configured to hold or secure a portion of a container. The base unit includes a heating surface and may optionally include an insert. In an embodiment, the actuator may be configured to apply a force or pressure on a container to contact the base unit, the base unit may be configured to receive a base portion of the container, and the heating surface may be configured to convey energy or heat to a portion of the base portion of said container. Embodiments of a method for providing a plastic container are also disclosed.

27 Claims, 14 Drawing Sheets

(56) References Cited

U.S. PATENT DOCUMENTS

| | | | | |
|---|---|---|---|---|
| 7,574,846 | B2 * | 8/2009 | Sheets et al. | 53/440 |
| 8,011,166 | B2 * | 9/2011 | Sheets et al. | 53/127 |
| 8,028,498 | B2 * | 10/2011 | Melrose | 53/281 |
| 2002/0004090 | A1 | 1/2002 | LaFleur | |
| 2002/0020149 | A1 | 2/2002 | Silvers et al. | |
| 2003/0110736 | A1 | 6/2003 | Boyd | |
| 2004/0131735 | A1 | 7/2004 | Korengel et al. | |
| 2005/0121408 | A1 | 6/2005 | Deemer et al. | |
| 2007/0051073 | A1 * | 3/2007 | Kelley et al. | 53/440 |
| 2010/0018166 | A1 | 1/2010 | Outreman | |

FOREIGN PATENT DOCUMENTS

| | | | |
|---|---|---|---|
| FR | 2 887 238 | | 12/2006 |
| FR | 2896232 | A1 | 7/2007 |
| WO | 2007127337 | A2 | 11/2007 |

* cited by examiner

SYSTEM AND METHOD FOR PRESSURIZING A PLASTIC CONTAINER

CROSS-REFERENCE TO RELATED APPLICATION

This application claims the benefit of U.S. Provisional Application No. 61/151,363, filed Feb. 10, 2009.

TECHNICAL FIELD

The present invention relates to a system and method for pressurizing a plastic container.

BACKGROUND

With light-weighting initiatives creating thinner container walls, manufacturers have attempted to alleviate associated problems with container strength reductions. Thin walled plastic containers can be prone to deforming or "ovalization," and may not be suitable for vending purposes as the force from such a drop can cause container rupture. Also, over a period of time, thin-walled containers with liquid contents can lose a fraction of their contents more rapidly than comparatively thicker-walled containers, which can lead to increased internal vacuum and deformation.

Thin walled plastic containers can be used for many purposes, including being filled with "hot" or "cold" contents. With "hot-fill" packages, containers are commonly filled with a heated or "hot" liquid product and capped while the product contents remain at an elevated temperature. As the product contents cool, the associated reduction in the volume of the contents can create a vacuum pressure within the container—i.e., an internal pressure that is less than the surrounding atmospheric pressure. If the container is comprised of a molded plastic, portions of the container walls may distort inwardly as the contents cool.

To address these concerns associated with containers, including thin-walled containers, whether for either "hot" or "cold" filling applications, some conventional containers are filled with an inert gas, such as nitrogen, prior to capping. This method adds internal pressure and external rigidity for a time. Further, some containers provide ribs, grooves, or relatively thicker wall portions on the container walls to strengthen the walls so as to reduce the effects of distortion. Still others may additionally utilize one or more vacuum panels to help account for or otherwise control the amount of distortion associated with an anticipated vacuum pressure. However, in addition to increasing the complexity of the container and manufacturing process, some or all of the aforementioned measures may be seen as aesthetically displeasing and/or may require additional material, which can contribute to increased weight and cost.

SUMMARY

A system for manufacturing a plastic container, which may include a thin-walled container, includes an actuator and a base unit. The actuator may include a body portion and a holding/securing member configured to hold or secure a portion of a container. The base unit includes a heating surface and may optionally include an insert. In an embodiment, the actuator may be configured to apply a force or pressure on a container to contact the base unit, the base unit may be configured to receive a base portion of the container, and the heating surface may be configured to convey energy or heat to a portion of the base portion of said container. Embodiments of a method for providing a thin-walled plastic container are also disclosed.

BRIEF DESCRIPTION OF THE DRAWINGS

Embodiments of the disclosure will now be described, by way of example, with reference to the accompanying drawings, wherein.

DETAILED DESCRIPTION

Reference will now be made in detail to embodiments of the present disclosure, examples of which are described herein and illustrated in the accompanying drawings. While the invention will be described in conjunction with embodiments, it will be understood that they are not intended to limit the invention to these embodiments. On the contrary, the invention is intended to cover alternatives, modifications and equivalents, which may be included within the spirit and scope of the invention as defined by the appended claims.

Figure 1:
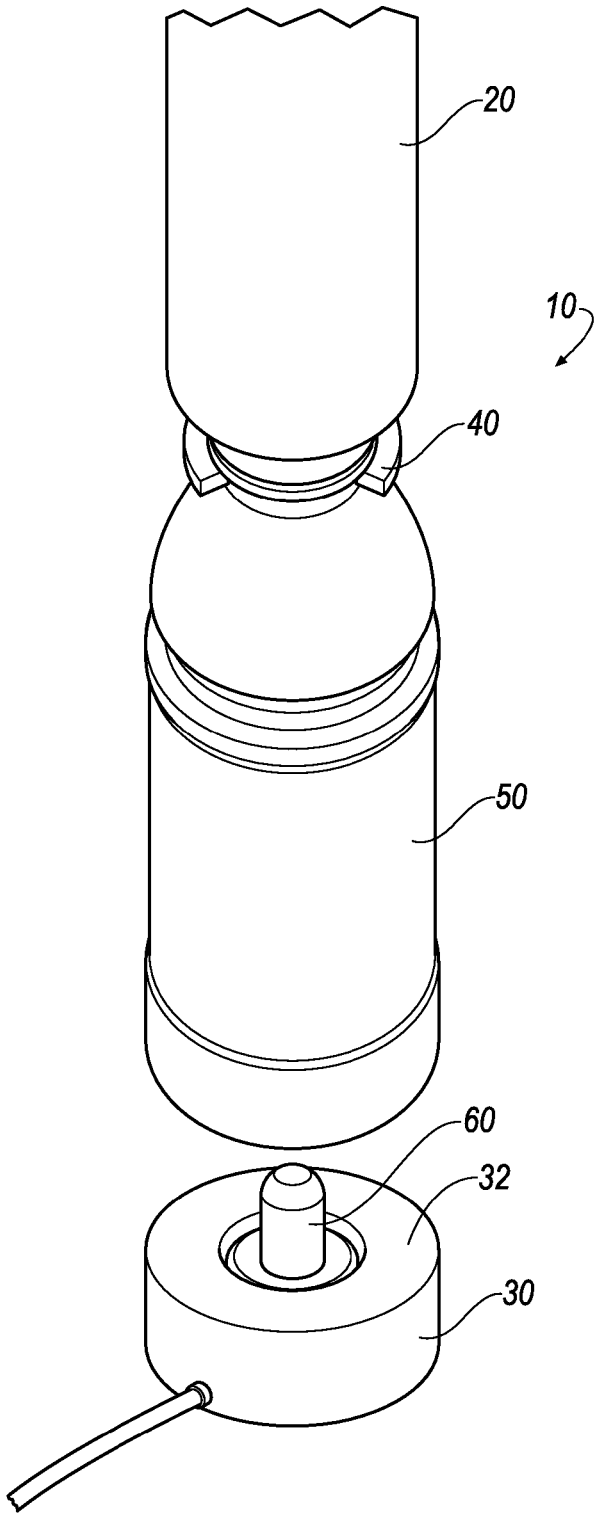
FIG. 1 is a perspective view representation of an embodiment of a system for pressurizing a container.

FIG. 1 generally illustrates a pressurizing system 10 in accordance with an embodiment of the present invention. The system 10 includes an upper component, or actuator 20, and a lower component, or base unit 30. The actuator 20 may include a holding/securing member 40 for holding and/or securing a portion of a container 50, and the base unit 30 may include principal heating surface 32 and a centering formation 60 that may, for example, take the form of a centering pin. Embodiments of the system and the methods disclosed herein may be employed in connection with various types of plastic containers, including thin-walled plastic containers. Such "thin-walled" plastic containers may include, for example, containers with wall thicknesses from about from about 0.12 mm (about 4.724409 mil) to about 0.31 mm (12.20472 mil), or less, and would include containers with walls within a subset range of from about 0.17 mm (6.692913 mil) to about 0.26 mm (10.23622 mil) thick.

In embodiments of the invention, the actuator 20 may move in at least one direction (e.g., linearly up-and-down) and may be controlled by various known power-control configurations. By way of example, without limitation, movement associated with the actuator 20 may be pneumatically controlled, hydraulically controlled, servo controlled, and/or controlled by an electric motor or drive system. As generally shown in FIG. 1, and additionally illustrated in FIGS. 2*a*, 2*b*, and 3, the actuator may include a holding/securing member 40. The holding/securing member 40 may, for example, be in the form of an open-faced (e.g., "C"-shaped) formation that is configured to hold and/or secure a portion of a container—such as an upper/neck portion of a container.

Figure 2A:
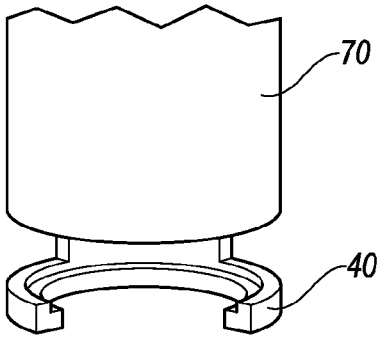
FIG. 2*a* is a general representation of a portion of an actuator that may used in connection with systems according to an embodiment, the holding/securing portion of the actuator shown in a first position.
Figure 2B:
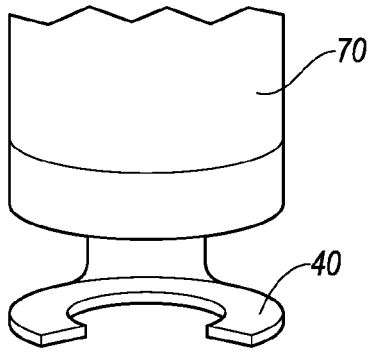
FIG. 2*b* is a general representation of a portion of an actuator that may used in connection with systems according to an embodiment, the holding/securing portion of the actuator shown in a second position.

Moreover, as generally illustrated in the embodiments shown in FIGS. 2*a* and 2*b*, the holding/securing member 40 may be provided in different configurations and, if desired to facilitate its holding/securing function, may be controllably translated or moved relative to an associated actuator body, generally designated 70. In an embodiment, the holding/securing member 40 may be movable (e.g., back and forth) along at least one direction relative to the actuator body 70. For example, without limitation, the holding/securing member 40 is generally shown in FIG. 2*a* in a first (e.g., comparatively "retracted") position, and is shown in FIG. 2*a* in a second (e.g., comparatively "extended") position. Such "retracted" positioning may be beneficial or desirable for holding/securing during processing, while such comparatively "extended" positioning may be beneficial for acquiring or releasing a container.

Figure 3:
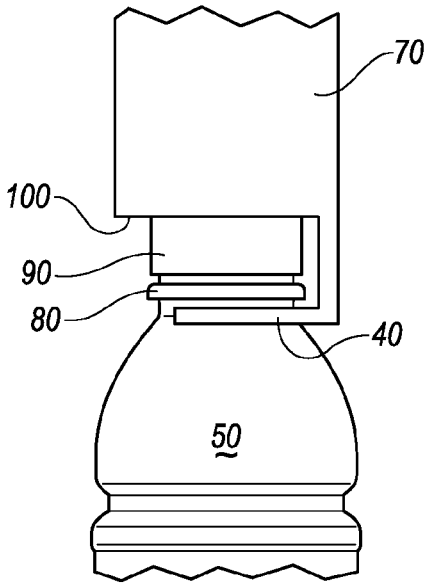
FIG. 3 is a general representation of an actuator of the type illustrated in FIGS. 2*a* and 2*b* shown holding/securing a plastic container.

As generally illustrated in FIG. 3, in embodiments, the actuator 20 may be configured such that a holding/securing member 40 is configured to retain and/or support a support flange 80 of an upper portion of container 50. Further as generally illustrated in FIG. 3, the holding/securing member 40 may be integral or formed in a unitary manner with the actuator body 70; the holding/securing member 40 may be configured to slide underneath a support flange 80; and/or a closure 90 associated with the container 50 may, upon being retained and/or supported by the holding/securing member, at some point thereafter be in (or may be urged into) contact with a lower surface 100 of the actuator body 70.

Figure 4:
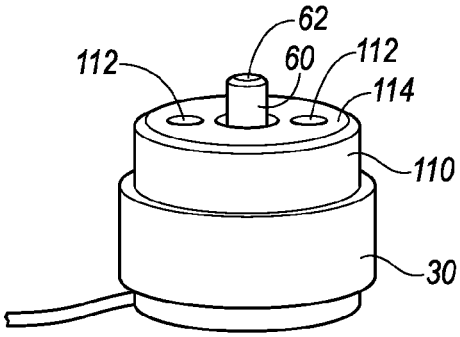
FIG. 4 is a general representation of a base unit according to an embodiment of the disclosure.

FIG. 4 generally illustrates an embodiment of a base unit 30. As shown in the illustrated embodiment, the base unit 30 may include a centering formation 60. In an embodiment, the centering formation 60 may be adjustable—e.g., in a vertical direction—with respect to the base unit 30. By way of example, without limitation, the centering formation 60 may be spring-loaded or otherwise outwardly biased in a vertical direction such that when a base of a container comes into contact with the centering formation 60, the centering formation 60 will adjust (i.e., provide a measure of "give" toward the base unit 30) while remaining in contact with the base of the container. In an embodiment, the centering formation may be configured to, among other things, operatively engage a portion of the base of a container (e.g., a container base dome) to prevent or reduce the amount of horizontal movement or sway associated with the container. Moreover, for some embodiments, the head or tip 62 of the centering formation 60 may be configured to interface for a more rigid or firm engagement with a portion of the base of an associated container.

As generally shown in FIG. 4, an insert 110 may be included with the base unit 30. An insert 110 can, be optionally included, for example, to configure the associated system to accommodate containers with different vertical lengths. If desired, the insert can be firmly, yet removably connected to the base unit 30, such as for example via one or more screw holes 112. In an embodiment, at least a portion of the insert 110 can be configured to provide (e.g., conduct) energy or heat provided from the base unit 30 to a base portion of a container—for instance via portions of surface 114. In embodiments of the system 10, the energy or heat may be electrically-derived heat or may comprise other forms of conductive-type energy or heat.

Figure 6:
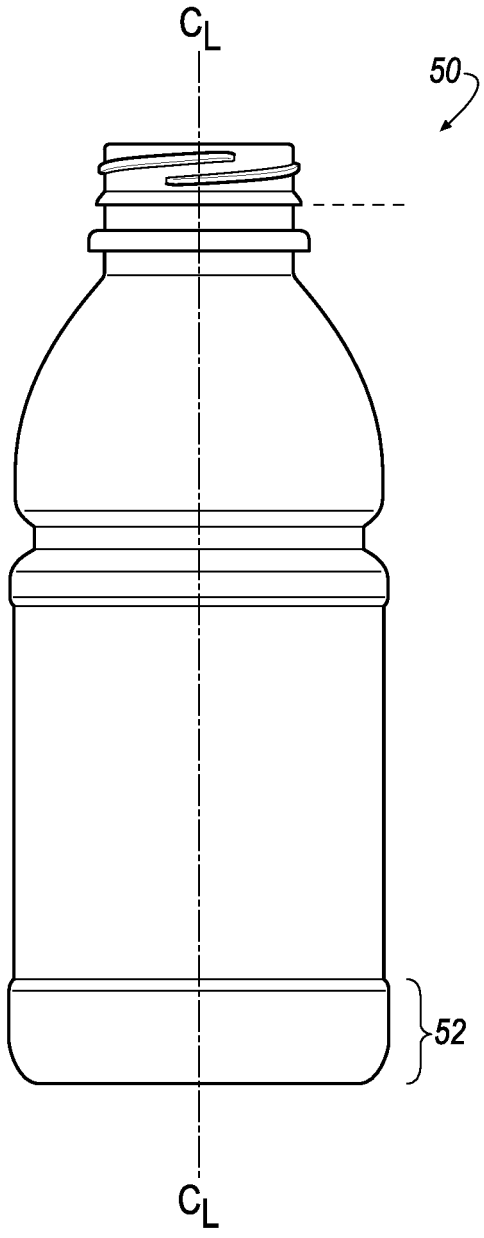
FIG. 6 generally illustrates a side elevation view of a plastic container of the type that may be used in connection with embodiments of the disclosure.
Figure 7:
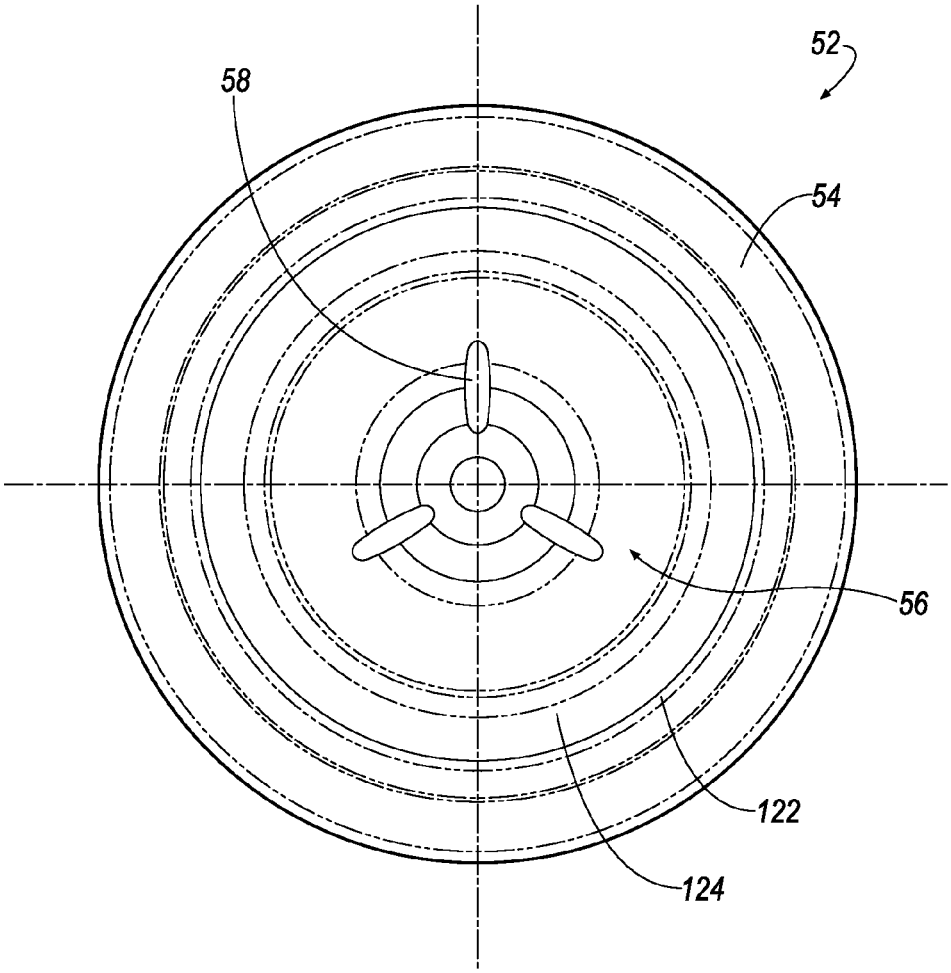
FIG. 7 is a bottom plan view of a container base portion according to an embodiment of the disclosure.

FIG. 6 generally depicts an embodiment of a plastic container 50 that might, for example, be accommodated by an embodiment of the system 10. The plastic container 50 includes a base portion 52, such as that generally illustrated in FIG. 7. However, it is noted that the present invention is not limited to the illustrated embodiment, and various other base configurations may be employed with the invention. As generally illustrated, and without limitation, the base portion 52 may include an annular support surface 54 that can be configured to support a plastic container 50 on an external surface. The base portion 52 may also include a central portion 56, which may include a domed or elevated portion—including those provided in connection with various conventional container base designs. Further, it is noted that the base portion 52 may optionally include one or more various other formations, such as, by way of example, structural reinforcing formations 58.

Figure 8A:
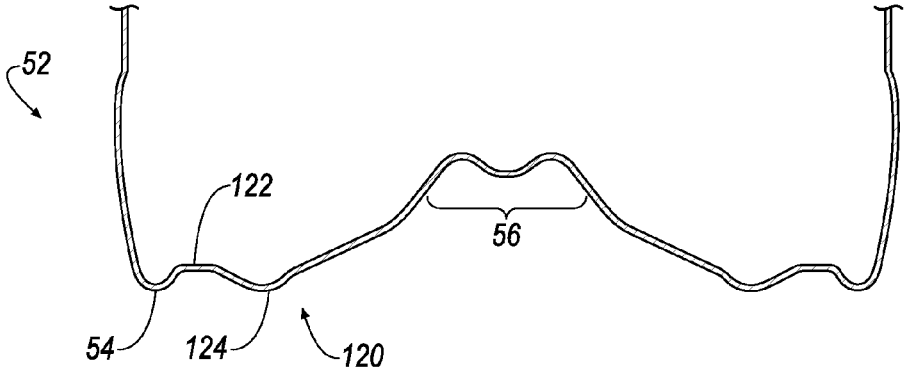
FIG. 8*a* is a side view outline of a container base portion according to an embodiment of the disclosure, shown prior to incurring internal vacuum pressure.
Figure 8B:
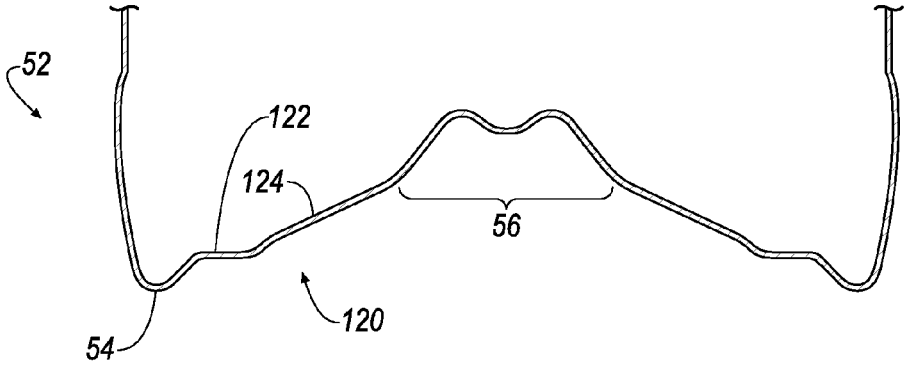
FIG. 8*b* is a side view outline of a container base portion according to an embodiment of the disclosure, shown after the effect of internal vacuum pressure.

As generally illustrated in the embodiment of a base portion 52 shown in FIGS. 8*a* and 8*b*, the base portion may include a transition segment or portion (generally designated 120) between the annular support surface 54 and the central portion 56. The transition segment or portion 120 may, as generally illustrated, include one or more steps 122, and may include one or more flexible or inversion segments or portions 124. FIG. 8*a* generally illustrates a side view outline of a container base portion 52 according to an embodiment providing hot-filled contents to the container, shown prior to incurring internal vacuum pressure. FIG. 8*b* generally illustrates the base portion 52 after incurring an internal vacuum pressure, such that the illustrated inversion section or portion 124 has moved upwardly (e.g., to be more concave) in response to at least a portion of the vacuum pressure.

Turning again to FIG. 4, in an embodiment, at least a portion of the base unit, or insert 110 (if an insert is utilized), may be configured to conduct energy or heat to specific/select portions of the base portion 52 of a container 50. By way of example, the conducting surface—whether that of a base unit or insert—that contacts the base portion 52 of the container 50 may be configured to supply energy or heat to all or a part of a portion or segment disposed between annular support surface 54 and a central portion 56. In an embodiment, the aforementioned contacting surface of the base unit (or insert) may be in contact with a substantial portion of a flexible or inversion segment or portion (e.g., 124 in FIGS. 8*a* and 8*b*). The system thus permits the controllable application of energy or heat to a select portion or portions of base portion 52.

Figure 5C:
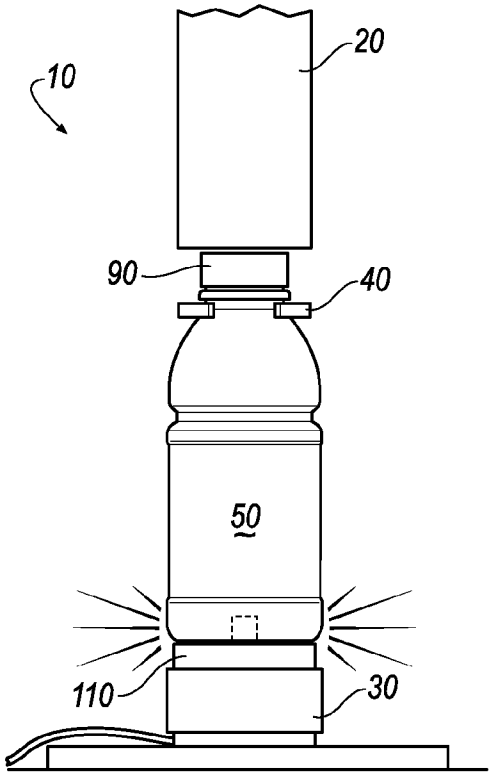
FIGS. 5*a* through 5*c* generally illustrate process stages associated with a system in accordance with an embodiment of the disclosure.
Figure 5B:
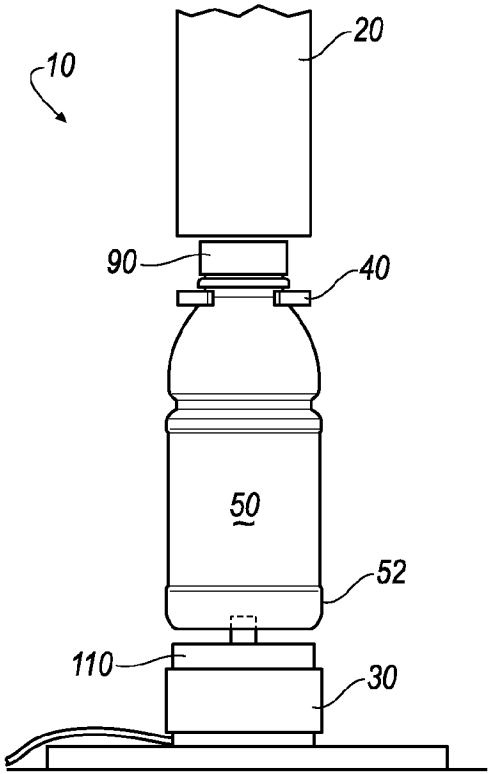
Figure 5A:
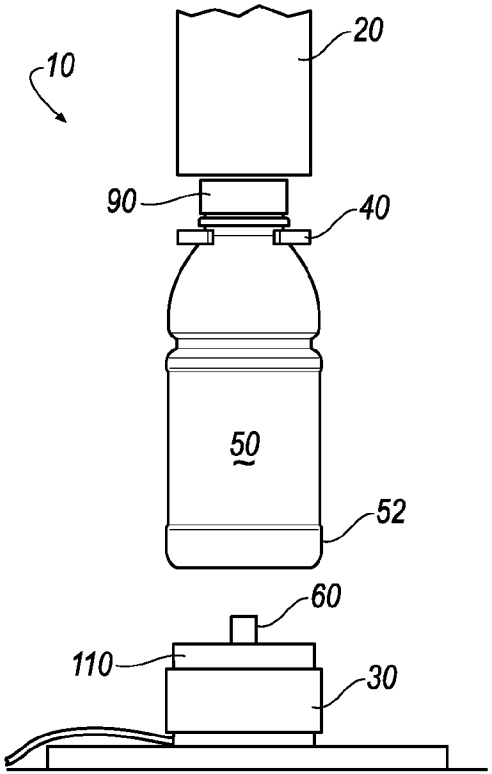

A method or process associated with an embodiment of the invention is generally represented in FIGS. 5*a* through 5*c*. As generally illustrated in FIG. 5*a*, an actuator including a holding/securing member 40 may acquire a container 50 having a base portion 52. At this stage in the processing, the container 50 has been filled with contents (e.g., at an elevated temperature from at least 150° F. to 210° F. (65° C. to 98.9° C.), and for some embodiments at an elevated temperature from at least 170° F. to 180° F. (77° C. to 82° C.)), and the container has been sealed and a closure (e.g., closure 90) has been applied. The container 50 may be cooled to a degree—to for example, for some embodiments between about 70° F. (21.1° C.) and about 120° F. (49° C.), and for other embodiments between about 80° F. (27° C.) and about 120° F. (49° C.), which may result in just a slight container deformation. It is noted that, depending upon the areas of "least resistance," portions of the sidewall of the container may distort (e.g., be pulled or sucked inwardly) in response to internal vacuum pressures associated with the cooling of the contents of the container 50. The container 50 may then be moved into position with respect to a base unit 30 and centering formation 60. The illustrated system 10 is shown involving the use of an insert 110, which may be optional for a number of applications. The insert 110 is shown provided about the centering formation 60 on the base unit 30. In embodiments of the system, the vertical distance (or travel spacing) between the lowermost portion of the base portion 52 of the container 50 and the top of the base unit 30 (or the insert 110, if present), may, without limitation, be three inches or less. For some embodiments, longer stroke cylinders may be employed. It is noted that by minimizing or reducing the distance that the container base 52 must to travel to contact or engage the base unit 30, cycle time may be correspondingly be reduced.

As shown in connection with the embodiment illustrated in FIG. 5*b*, the actuator 20 may move container 50 toward the base unit 30 and a centering formation 60. The base portion 52 of the container 50 eventually will contact and/or engage the centering formation 60, which may be configured to retract (or provide a measure of "give" until the base portion 52 comes into operative communication/contact with the base unit 30 and/or insert 110 (to the extent that an insert is provided).

As generally illustrated in FIG. 5*c*, portions of the container 50 may be moved into operative contact or communication with the actuator 20 and the base unit 30 and/or insert 110. The actuator 20 may exert a measure of downward pressure or force on a portion of the container 50 (e.g., closure 90) and at least a portion of the base portion 52 of the container may come into contact with a conductive portion or region of the base unit 30 and/or insert 110 that is configured to conduct energy or heat. In an embodiment, a heat or energy with a temperature of at least about 200° F. is applied from the base unit 30 to the container base portion 52. In an embodiment, for example and without limitation, the conductive portion may provide about 450° F. to the select area of the base portion 52. The base unit 30 may apply heat to the container base for about 1 to 6 seconds, and for some embodiments for about one second or less. The actuator 20 may, for example, apply a downward top pressure of from about 30 pounds-force (133 N) to about 190 pounds-force (845 N). Without limitation, some embodiments will nominally apply about 125 pounds-force (556 N). Such top pressure/force may, among other things, help to stabilize internal pressure and urge the sidewalls of the container back into place, as well as help make the base more rigid (due to associated plastic memory, the walls of the base will now tend not to push back) and generally increase container strength. The system thus provides a measure of controllable downward pressure and application of energy and/or heat that can be controlled or adjusted separately or in various combinations. In embodiments of the invention, the total cycle time associated with the processes generally illustrated in FIGS. 5*a* through 5*c* may be two to eight seconds (and may be three to four seconds, or less), and the time in which the base portion 52 of the container 50 is in contact with the base unit 30 and/or insert 110 may be as little as one second or less.

Figure 9A:
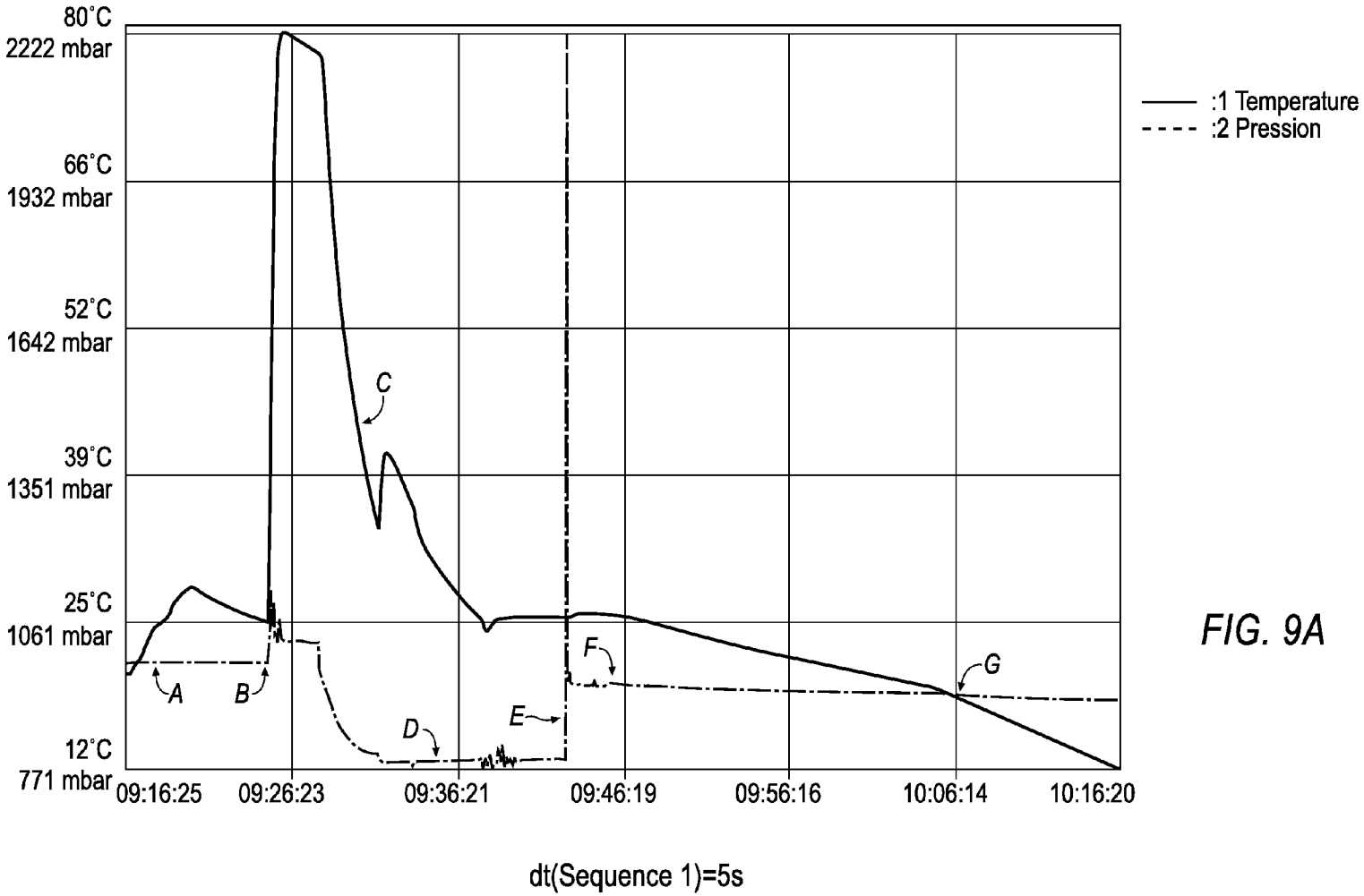
FIG. 9A is a chart generally illustrating temperature and pressure profiles associated with a process in accordance with an embodiment of the disclosure.
Figure 9B:
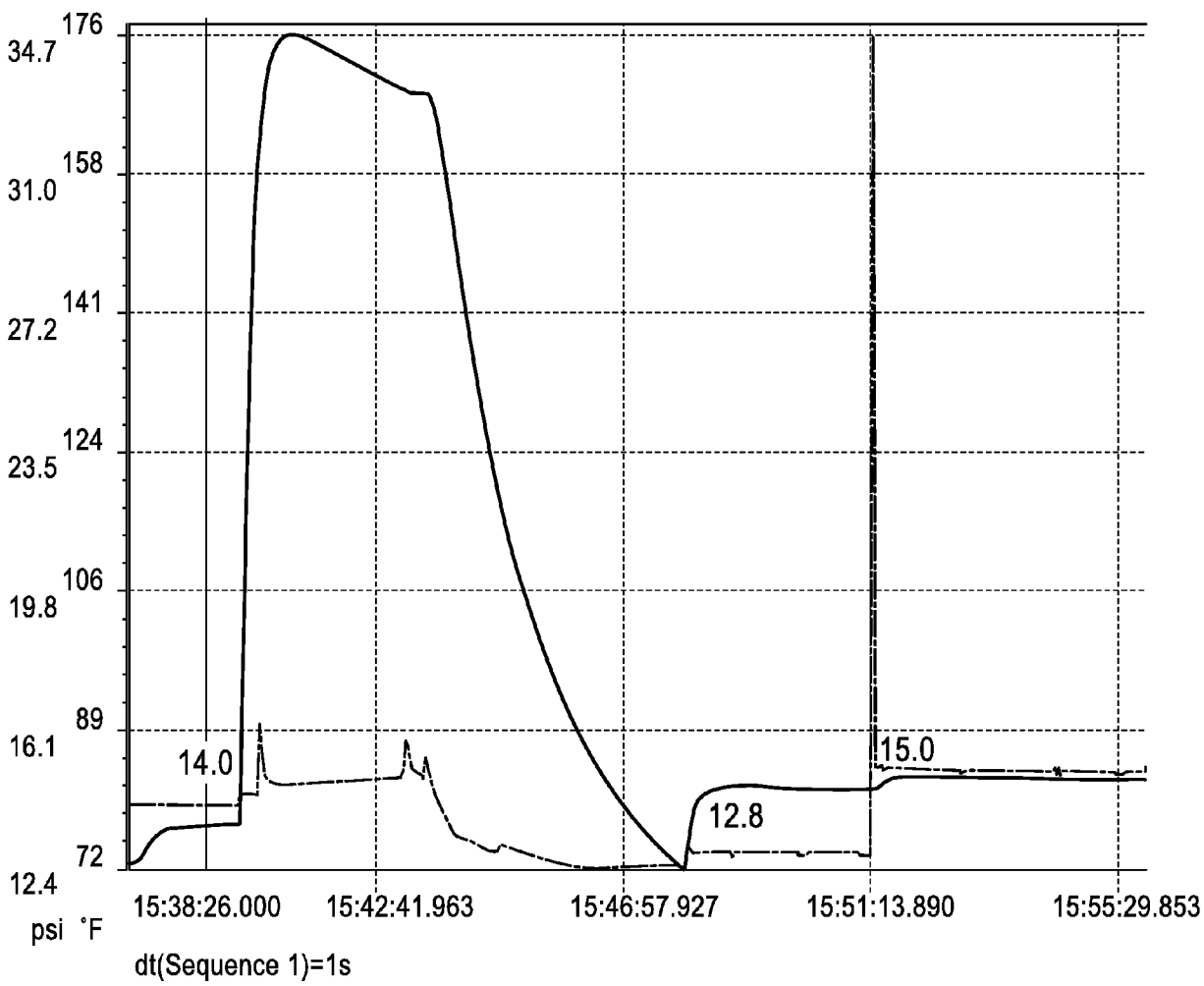
FIG. 9B is a chart generally illustrating temperature and pressure profiles associated with a process in accordance with another embodiment of the disclosure.

A chart generally illustrating temperature and pressure profiles that may be associated with a process in accordance with a "hot-fill" embodiment of the present invention is shown in FIG. 9A. Turning to the chart, at point A, a plastic container is delivered to a fill site. The fill site may, for instance, be at or about an atmospheric pressure of, for example, 979.056 mbar (14.2 psi). Along the segment generally identified as B, the container may be filled with contents at an elevated temperature and then may be sealed/capped (the maximum temperature for some embodiments may be about 80° C. (176° F.)). At or about the start of segment C, which may begin just after the apex of the temperature associated with hot-filling is reached, the container may begin an assisted cooling (e.g., in connection with a cooling tunnel or cold bath), with the temperature dropping from, for example, about 80° C. (176° F.) to about 30° C. (86° F.) in five to six minutes or less. The decline in temperature may correspond with the internal pressure becoming negative, and producing an internal vacuum, with the pressure, for example, dropping to at or about 786.002 mbar (11.4 psi) (near point D). Around that pressure, the temperature for the illustrated embodiment is now around or about 25° C. (77° F.). At or about point E, the container base portion is inverted with the application of pressure and/or heat—for example in connection with the previously described system. The charted embodiment shows the internal pressure spiking at this "moment of inversion" to, for example, about 2220.112 mbar (32.2 psi) and quickly subsequently dropping off. It is noted that, depending on the configuration of the container, it may not be necessary to use this much pressure to invert the base portion. At or about point F, the pressure begins to normalize to about 917.003 mbar (13.3 psi). Moreover, due to the associated inversion associated with the container base, the pressure will start to stabilize closer to atmospheric pressure. By around point G, the temperature may tend to drop further, for example, to below the reading of about 18° C. (64.4° F.), but the internal pressure will remain fairly consistent at or around 917.003 mbar (13.3 psi) and will commonly—unless subjected to unusual environmental conditions—not move much at all thereafter. FIG. 9B includes a chart generally illustrating temperature and pressure profiles that may be associated with a process in accordance with another embodiment of the system.

Figure 10:
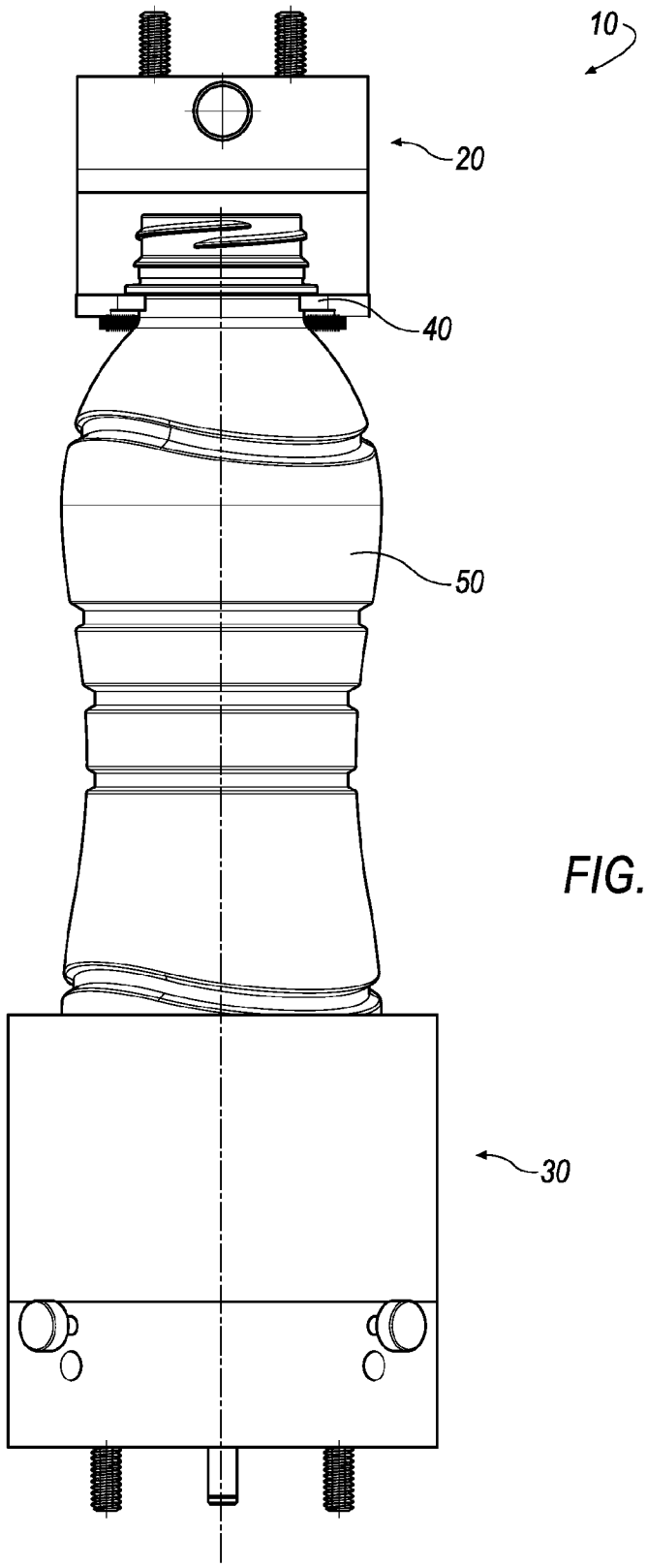
FIG. 10 is a front elevation view of an embodiment of a system for pressurizing a container.
Figure 11:
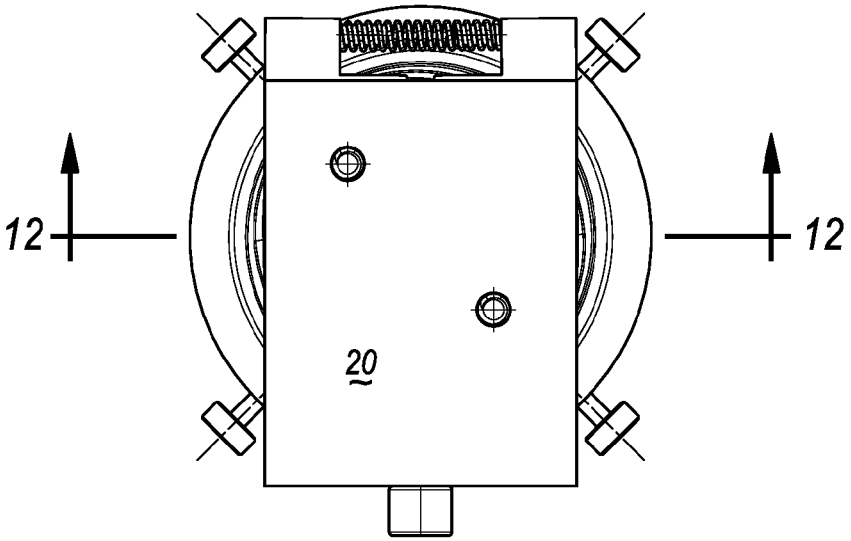
FIG. 11 is a top view of the system illustrated in FIG. 10.

FIG. 10 generally illustrates a pressurizing system 10 in accordance with another embodiment of the present invention. The system 10 includes an upper component, or actuator 20, and a lower component, or base unit 30. The actuator 20 may include a holding/securing member 40 for holding and/or securing a portion of a container 50. FIG. 11 illustrates a top view of the system shown in FIG. 10.

Figure 12:
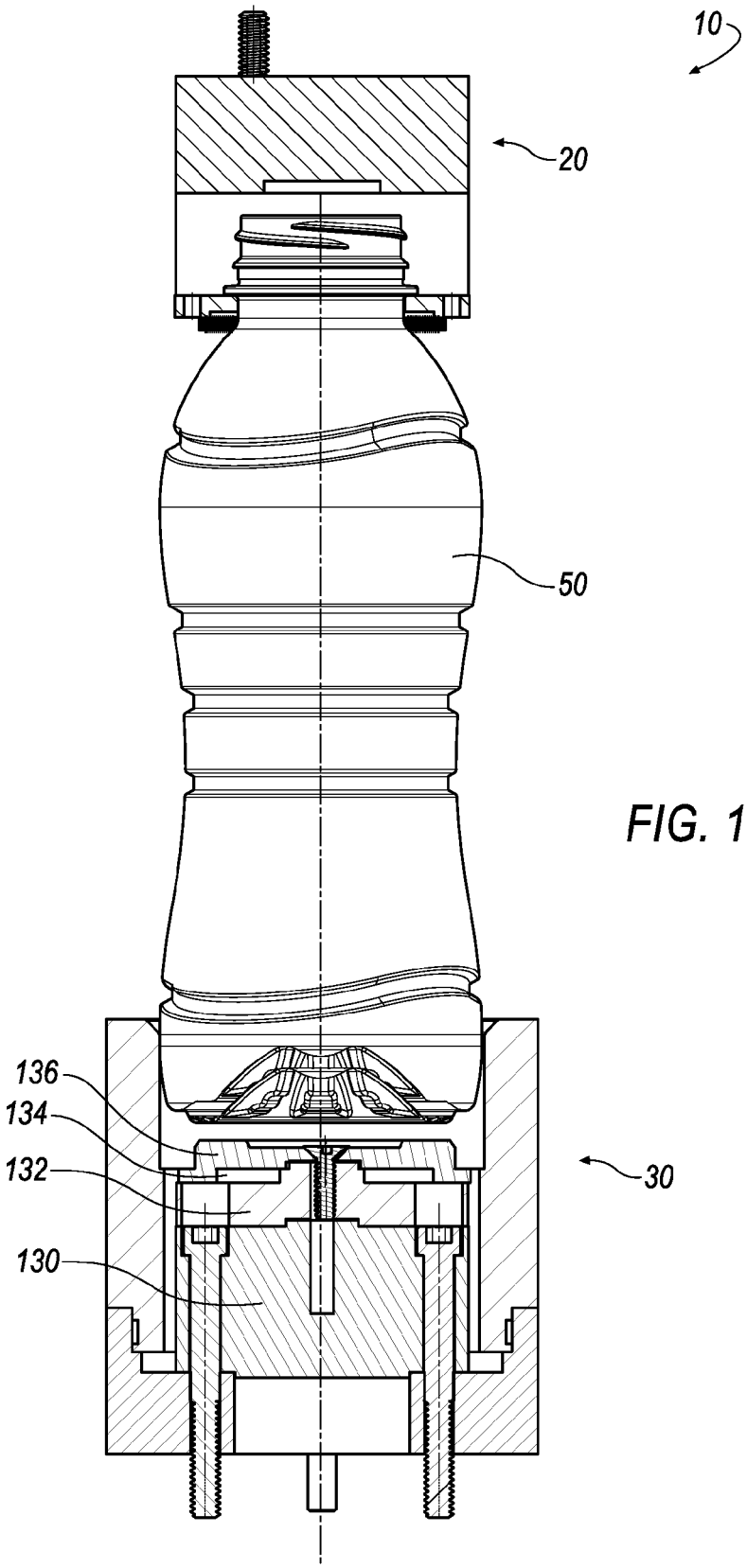
FIG. 12 is a sectional view of the system illustrated in FIG. 10, viewed in the direction of section 12-12.
Figure 13:
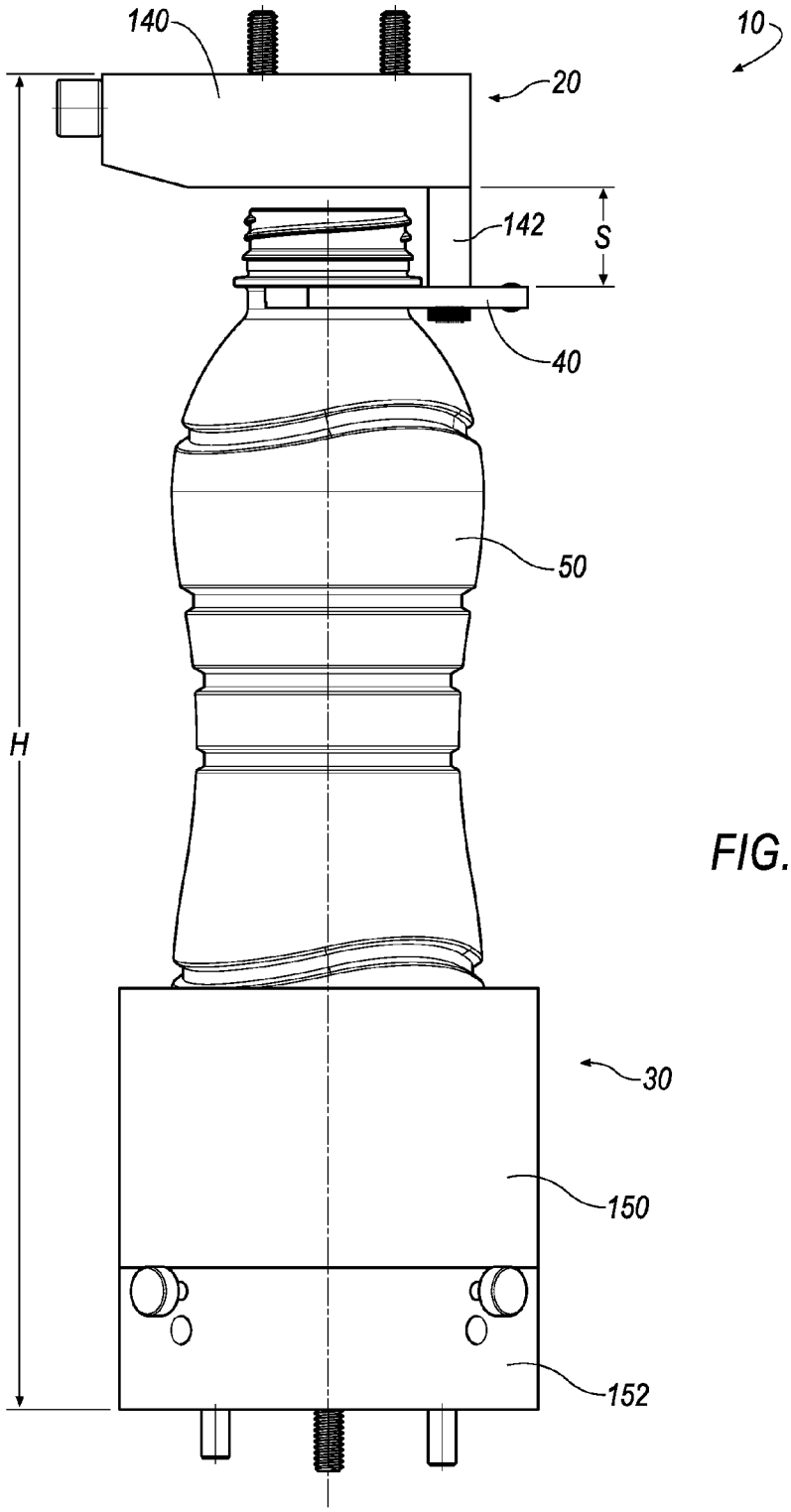
FIG. 13 is a side elevation view of the system illustrated in FIG. 10.

FIG. 12 provides a sectional view of the system 10 shown in FIG. 10, and shows aspects of the base unit 30 in additional detail. As illustrated, an embodiment of the base unit may include a spacer 130, a top insulator 132, a heater or heating element (e.g., a ceramic heater) 134, and a cap 136. It is noted that embodiments of the system may employ several types of heaters including, without limitation, resistant, inductive, or gas (which could come in the form of rod, coil, band, or disk), and which may be comprised of several materials (including ceramic, metal, or composite). FIG. 13 shows the system 10 from a different (side) view. The illustrated system 10 shows an actuator 20 that includes, inter alia, a hanger block 140, a bottle neck spacer 142, and a holding/securing member 40 (in the form of spaced grippers) for holding and/or securing a portion of bottle 50. The spacer 142 can be configured to provide a sufficient space S for accepting an uppermost portion of the container 50. By way of example, without limitation, the space S provided in connection with a 500 ml bottle might be in the order of 0.880 inches. The base unit 30 of the illustrated embodiment is shown including centering ring 150 and a sleeve 152. As generally illustrated, the assembly 10 may have a total height H that, for some embodiments may be less than 12 inches. However, the assembly is not limited to a specific height, and the height (as well as other dimensions of the system) can be configured/adjusted to accommodate an intended container size.

Figure 14:
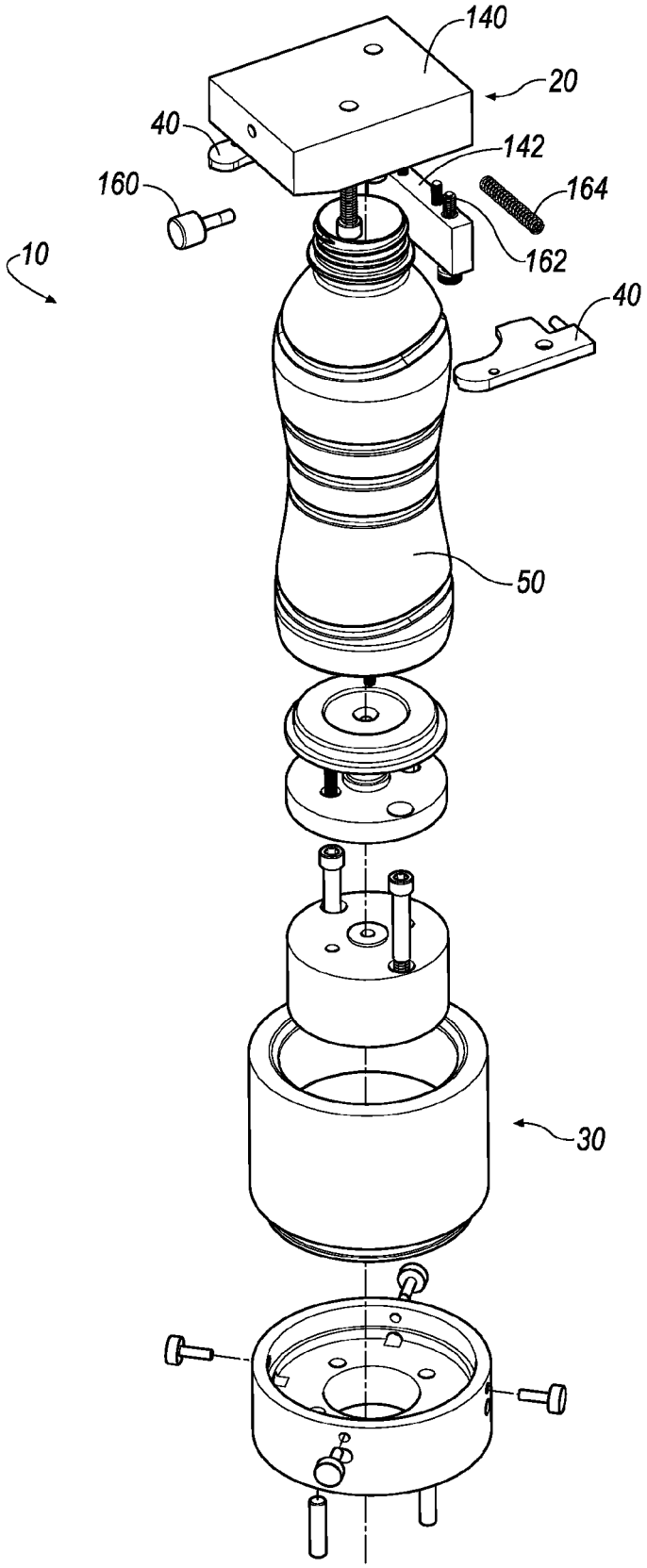
FIG. 14 is a perspective assembly/exploded view of an embodiment of a system.
Figure 15:
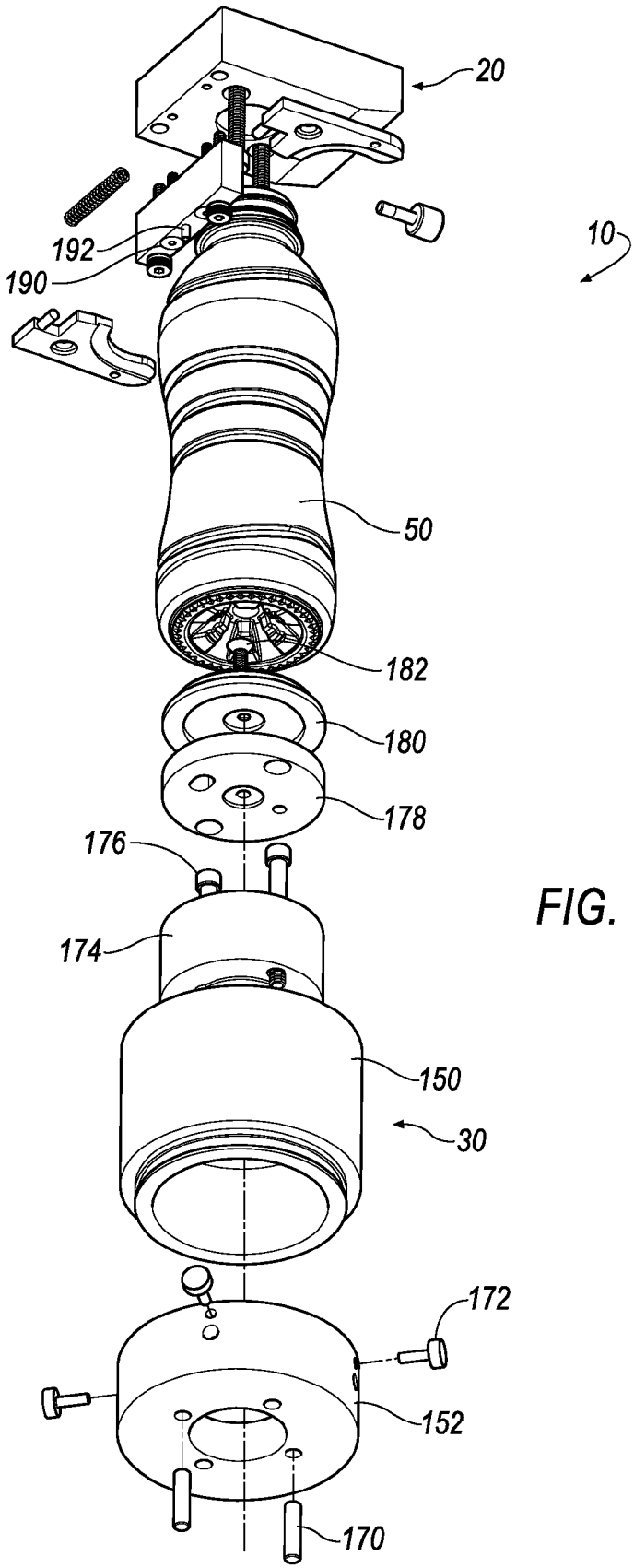
FIG. 15 is a perspective assembly/exploded view of the embodiment of a system shown in FIG. 14, shown from a different direction.

FIGS. 14 and 15 show assembly/exploded views of an embodiment of the system 10, shown from two different perspectives. The figures show elements of the system 10, including embodiments of an actuator 20 and a base unit 30 in further detail. As illustrated in FIG. 14, the actuator 20 may include a multi-component holding/securing member 40 (shown with left and right components), a track roller/stud mount 160, a shoulder screw 162, and a spring 164 (e.g., a compression spring). As illustrated in FIG. 15, an embodiment of the base unit 30 may include dowel pins 170, screws 172 (e.g., thumb screws), a base unit spacer 174, a screw head (e.g., a socket head cap screw) 176, an insulator 178, and a cap 180 (which may, for example be secured by a screw 182). With respect to the actuator 20, FIG. 15 also shows a cap screw 190 and dowel pin 192.

With embodiments of the invention, an initial vacuum pressure may, for example and without limitation, be about −3 psi. It is, however, noted that the initial value will change depending upon the resistance associated with the respective container, i.e., containers that are more structurally rigid may require a higher initial internal vacuum. Embodiments of process associated with the invention can help maintain the encountered pressure within +/−2 psi from atmospheric pressure. That is, the desired final filled container internal pressurization may be within the range of −2.0 psi to 2.0 psi of atmospheric pressure. Moreover, for some embodiments, the final filled internal pressure may be maintained within +/−1 psi from atmospheric pressure. For many embodiments of the system a positive atmospheric pressure is considered more desirable than a negative one. Further, for example and without limitation, if atmospheric pressure at a filling location is about 14.0 psi, the present system and process can provide a resulting filled and closed container that has an internal pressure within the range of 12.0 psi and 16.0 psi, and may provide for containers with such internal pressures between 13.0 psi and 15.0 psi.

It is noted that the use of embodiments of the invention may be advantageous with respect to the lightweighting of plastic container for hot-fill applications. Embodiments of the system and process can permit the provision of a plastic container, e.g., a polyethylene terephthalate (PET) container, that due to the handling of internal pressures via the container base portion requires a reduced amount of material in portions of the container and/or may require less (or no) structures, such as vacuum panels, to accommodate anticipated vacuum pressure.

It is also noted that the use of embodiments of the invention may be advantageous with respect to the lightweighting of plastic containers for cold-fill applications, including applications where improved vendability may be desirable. Embodiments of the system and process can provide a plastic container, e.g., a polyethylene terephthalate (PET) container, that given the handling of internal pressures via the container base portion, may require a reduced amount of material in portions of the container and/or may require less (or no) structures or treatment with inert gas to accommodate anticipated drop forces.

Further, embodiments of the system and process can provided for significantly increased efficiencies in a production environment. While just a single system (which may be said to be a unit or station) is illustrated in FIG. 1, embodiments of the invention contemplate devices that provide a plurality of such systems. Embodiments of the invention may provide a system or apparatus that include a plurality of systems for example, a plurality of actuators and base units may be provided in paired equidistantly-spaced, radially-extending sets about the outer periphery of a rotary wheel. With such multi-set systems or apparatus, each individual system (which in this instance may be referred to as a sub-system or station) may include an associated base unit and corresponding actuator. Such a rotary system could includes as many as 6 to 48 sub-systems or more. Further, cycle times for such a rotary system could, for instance, be timed to run at about 4 seconds or 15 revolutions per minute.

The foregoing descriptions of specific embodiments of the present invention have been presented for purposes of illustration and description. They are not intended to be exhaustive or to limit the invention to the precise forms disclosed, and various modifications and variations are possible in light of the above teaching. The embodiments were chosen and described in order to explain the principles of the invention and its practical application, to thereby enable others skilled in the art to utilize the invention and various embodiments with various modifications as are suited to the particular use contemplated. It is intended that the scope of the invention be defined by the claims and their equivalents.

What is claimed is:

1. A system for manufacturing a filled plastic container, the system comprising:

an actuator including a body portion and a holding/securing member configured to hold or secure a portion of said container such that a base portion of said container is not held;

a base unit including a heating surface; and wherein the actuator is configured to apply a linear force or pressure on said container to such that a portion of the base portion directly contacts the base unit; the base unit is configured to receive the portion of the base portion of said container; the heating surface is configured to convey energy or heat to the portion of the base portion of said container; and, during the conveyance of energy or heat to the portion of the base portion, the base unit is substantially fixed in the direction of travel of the actuator.

2. The system according to claim 1, wherein the base unit includes a centering formation.

3. The system according to claim 2, wherein the centering formation includes a centering pin configured to extend beyond a principal heating surface of the base unit and into a recessed portion of the base portion of said container.

4. The system according to claim 2, wherein the centering formation is configured to move linearly toward and away from the actuator, and the centering formation includes a means for biasing the centering formation in the direction toward the actuator.

5. The system according to claim 1, wherein the base unit includes an insert that is configured to be disposed between the base unit and said container.

6. The system according to claim 5, wherein the insert includes an upper surface that is configured to operatively engage a portion of the base portion of said container.

7. The system according to claim 1, wherein the holding/securing member is configured to move in a linear direction towards and away from the body portion of the actuator.

8. The system according to claim 1, wherein the holding/securing member is rigidly fixed with respect to the actuator.

9. The system according to claim 1, wherein the holding/securing member is configured to slide underneath and support an upper portion of said container.

10. The system of claim 1, wherein the system comprises a plurality of actuators and a plurality of base units.

11. The system of claim 10, wherein the system includes a rotary wheel; and the plurality of actuators and base units are provided in paired equidistantly-spaced, radially-extending combinations about the outer periphery of a rotary wheel.

12. The system of claim 1, wherein the system is configured for manufacturing a hot-filled plastic container.

13. The system of claim 1, wherein the system is configured for manufacturing a cold-filled plastic container.

14. A method for providing a filled plastic container, the method comprising:

providing a closed or sealed plastic container with contents;

conveying the plastic container to a base unit container such that a base portion of said container is not held, the base unit configured to engage or contact at least a portion of the base portion of the plastic container; and applying a linear force or pressure directed to urge the plastic container into engagement or contact with the base unit; and conducting energy or heat to at least a portion of the base portion of the plastic container when the base portion is in operative contact with the base unit;

wherein during the conducting of energy or heat to the at least a portion of the base portion, the base unit is substantially fixed in the direction of travel of the actuator.

15. The method of claim 14, wherein the base unit includes an insert configured to engage or contact at least a portion of the base portion of the plastic container, and the insert is configured to conduct energy or heat to as least a portion of the base portion.

16. The method of claim 14, including permitting a portion of the base portion of the plastic container to invert during or after the application of the energy or heat.

17. The method according to claim 14, wherein the energy or heat is applied for about one second or less.

18. The method according to claim 14, wherein the energy or heat applied to at least a portion of the base portion of the plastic container is about 400° F.

19. The method according to claim 14, wherein after applying the energy or heat, the internal pressurization of the container is within the range of −2.0 psi to 2.0 psi of atmospheric pressure.

20. The method according to claim 14, wherein after applying the energy or heat, the internal pressurization of the container is within the range of −1.0 psi to 1.0 psi of atmospheric pressure.

21. The method according to claim 14, wherein the force or pressure directed to urge the plastic container into engagement or contact with the base unit is within the range of about 1 psi to about 50 psi.

22. The method according to claim 14, wherein the contents are provided at an elevated temperature.

23. The method according to claim 14, wherein the contents are provided at room temperature or below.

24. A method for providing a filled plastic container, the method comprising:

providing a plastic container with a top and base portion;

filling the plastic container with contents;

closing or sealing the plastic container;

presenting the container such that the base portion is not held;

applying a linear force or pressure to the top of the plastic container; and applying energy or heat to a portion of the base portion of the plastic container by a base unit, wherein, during the application of energy or heat, the base unit is substantially fixed in the direction of linear force or pressure applied to the top of the plastic container.

25. A method according to claim 24, wherein the plastic container is filled with contents at an elevated temperature.

26. A method according to claim 24, wherein the plastic container is filled with contents at or below room temperature.

27. A method for providing a hot-filled plastic container, the method comprising:

providing a plastic container with a top and base portion;

filling the plastic container with contents at an elevated temperature;

closing or sealing the plastic container;

cooling the contents of the plastic container or allowing the contents of the container to cool;

permitting a portion of the plastic container to provide an internal volume reduction in response to an internal pressure associated with the cooling of the contents of the plastic container;

presenting the container such that the base portion is not held;

applying a linear force or pressure to the top of the plastic container; and applying energy or heat to a portion of the base portion of the plastic container without forcing the base portion of the plastic container in a direction opposing the application of the linear force or pressure.

* * * * *

UNITED STATES PATENT AND TRADEMARK OFFICE

CERTIFICATE OF CORRECTION

PATENT NO. : 8,596,029 B2
APPLICATION NO. : 12/702370
DATED : December 3, 2013
INVENTOR(S) : Marc Pedmo et al.

It is certified that error appears in the above-identified patent and that said Letters Patent is hereby corrected as shown below:

In the Claims:

COLUMN 9, line 34, Claim 14,
delete the second instance of "container"

COLUMN 9, line 50, Claim 15,
delete "as" and insert -- at --

Signed and Sealed this
Twenty-fifth Day of February, 2014

Michelle K. Lee

Michelle K. Lee
*Deputy Director of the United States Patent and Trademark Office*